US007434417B2

(12) United States Patent
Lee

(10) Patent No.: US 7,434,417 B2
(45) Date of Patent: Oct. 14, 2008

(54) COOLING AIR FLOW PASSAGE OF REFRIGERATOR

(75) Inventor: Wook Yong Lee, Incheon-si (KR)

(73) Assignee: LG Electronics Inc., Seoul (KR)

( * ) Notice: Subject to any disclaimer, the term of this patent is extended or adjusted under 35 U.S.C. 154(b) by 285 days.

(21) Appl. No.: 11/214,829

(22) Filed: Aug. 31, 2005

(65) Prior Publication Data

US 2006/0096310 A1 May 11, 2006

(30) Foreign Application Priority Data

Nov. 9, 2004 (KR) ..... 10-2004-0090747

(51) Int. Cl.
*F25C 1/12* (2006.01)

(52) U.S. Cl. ..... 62/353; 62/338

(58) Field of Classification Search ..... 62/340–356, 62/337–339, 404–426, 389–390
See application file for complete search history.

(56) References Cited

U.S. PATENT DOCUMENTS 3,429,140 A 2/1969 White
3,827,256 A * 8/1974 Wiesner ..... 62/330
4,739,629 A * 4/1988 True ..... 62/338
4,970,871 A * 11/1990 Rudick ..... 62/187
5,442,933 A 8/1995 Unger
5,473,911 A 12/1995 Unger
5,474,213 A 12/1995 Unger
5,526,854 A 6/1996 Unger
6,694,761 B2 2/2004 Cho et al.
6,945,068 B2 * 9/2005 Kim et al. ..... 62/353
7,194,872 B2 * 3/2007 Kim et al. ..... 62/338

FOREIGN PATENT DOCUMENTS

WO 03/102481 12/2003

* cited by examiner

*Primary Examiner*—William E Tapolcai
(74) *Attorney, Agent, or Firm*—Greenblum & Bernstein, P.L.C.

(57) ABSTRACT

A cooling air flow passage of a refrigerator is provided. The cooling air not only flows through the passage so as to make ice in an ice making chamber but is also sent so as to cool water in a water storage tank. Therefore, the cooling air flow passage of the refrigerator and the overall structure of the refrigerator are simplified, which increases the efficiency of the refrigerator and reduces the manufacturing cost.

22 Claims, 6 Drawing Sheets

COOLING AIR FLOW PASSAGE OF REFRIGERATOR

BACKGROUND OF THE INVENTION

1. Field of the Invention

The present invention relates to a refrigerator, and more particularly, to a cooling air flow passage in a refrigerator. Still more particularly, the present invention relates to a cooling air flow passage of a refrigerator capable of improving the operational efficiency and simplifying the structure of the refrigerator by allowing cooling air to be efficiently supplied to and used at an ice making unit.

2. Description of the Related Art

An ice making unit for making ice is attached to the inside of a refrigerator and makes ice of an adequate size for providing to a user. Also, as users' tastes are recently becoming more luxury-oriented, there is an increasing trend for a refrigerator to have a built-in type ice maker mounted to its in side.

Furthermore, a refrigerator has a self-contained water dispensing passage for allowing water that is obtained from an outside source to be cooled and dispensed directly to a user via a water dispenser. For this purpose, the refrigerator has a water tank in its predetermined position, and a water tank cooling unit for cooling the water accommodated in the water tank.

However, since separate cooling air flow passages are needed to supply the cooling air that has been cooled in an evaporator to an ice making unit and a water dispenser according to the prior art, the structure of the cooling air flow passages in a refrigerator is complicated.

Furthermore, since the structure of the cooling air flow passages are complicated, the thickness of a refrigerator's walls increases, thereby reducing the area available for foodstuff storage and thus increasing the overall size of the refrigerator.

Also, because of the complications of the cooling air flow passage's structure, cooling air loss is increased during transfer of the cooling air and resultantly energy efficiency is deteriorated.

Moreover, when a refrigerator employs separate rooms for refrigerating and freezing, and an ice making unit and a water tank are built inside the refrigerating room, the problems of reduced storage space and increased cooling air loss become severe.

SUMMARY OF THE INVENTION

Accordingly, the present invention is directed to a cooling air flow passage of a refrigerator that substantially obviates one or more problems due to limitations and disadvantages of the related art.

An object of the present invention is to provide a cooling air flow passage of a refrigerator, capable of increasing the energy efficiency of the refrigerator by simplifying the structure and reducing the length of the passage.

Another object of the present invention is to provide a cooling air flow passage of a refrigerator, capable of making structure of the refrigerator small by adopting simplified cooling air flow passages.

A further another object of the present invention is to provide a cooling air flow passage of a refrigerator, capable of simplifying the structure of the refrigerator and reducing manufacturing costs by incorporating the ice making unit and the water tank into a single unit, thereby reducing the length of the cooling air flow passage.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the present invention, there is provided a cooling air flow passage of a refrigerating apparatus including: an ice making chamber for making ice using cooling air that is provided from an outside source; a water storage tank for cooling the water accommodated in its inside using cooling air from the ice making chamber; and a connecting duct for connecting the ice making chamber with the water storage tank, so that the cooling air from the ice making chamber may be guided to the water storage tank.

In an aspect of the present invention, a cooling air flow passage of a refrigerator includes: an ice making chamber for providing ice to an ice dispenser; a water storage tank for providing cold water to a water dispenser; a connecting duct for connecting the ice making chamber with the water storage tank; and a passage that touches one end of the ice making chamber, for supplying cooling air.

In another aspect of the present invention, a cooling air flow passage of a refrigerator includes: an ice making unit installed in a refrigerator door; a water dispensing unit installed closely to the ice making apparatus; a connecting duct for guiding cooling air from the ice making unit to the water dispensing unit; and a passage that touches one end of the ice making unit, for allowing the intake and discharge of cooling air.

According to the cooling air flow passage for the refrigerator, both the ice making unit and the water dispensing unit can be simultaneously operated by the cooling air supplied through the single cooling air flow passage. Because a separate passage for supplying cooling air to the water dispensing apparatus is not needed, the overall length of the passage can be shortened, the efficiency of the refrigerator is increased, the structure of the refrigerator is simplified, the refrigerator's structure is made smaller, and thus the manufacturing cost is reduced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
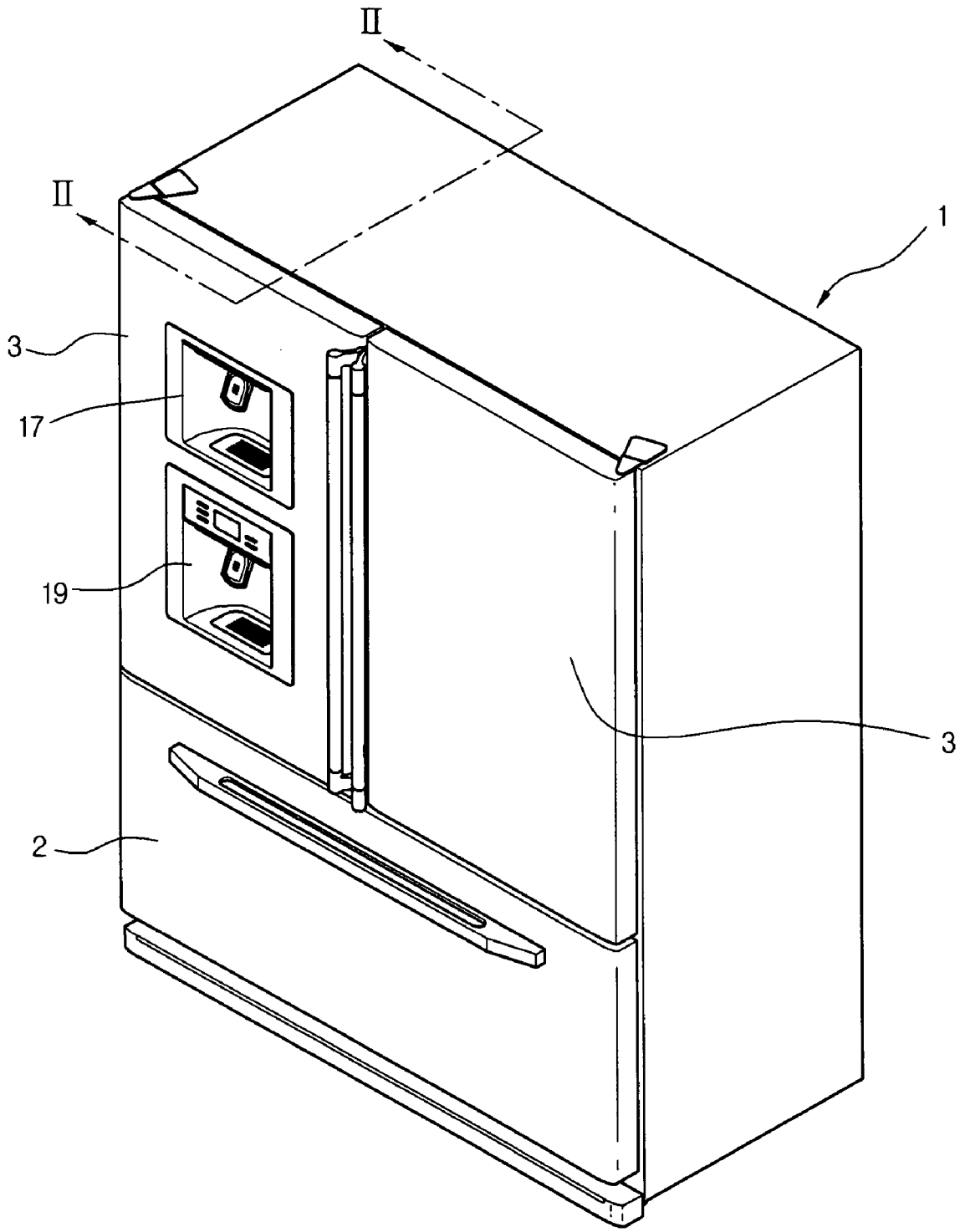
FIG. 1 is a perspective view of a refrigerator to which the present invention is applied.

FIG. 1 illustrates a bottom freezer-type refrigerator (in which refrigerating rooms are located in the top portion and the freezing rooms are located in the bottom portion) to which the present invention can be applied.

On the main body of a refrigerator 1, a freezing room door 2 is located at the bottom and a refrigerating room door 3 is located at the top. Furthermore, an ice dispenser 17 for dispensing ice and a water dispenser 19 for dispensing at least cold water are located on the front portion of the refrigerating room door 3. As illustrated, the ice and water dispensers can be separated and can constitute a single unit. Further, ice or water can be selectively supplied by pressing a predetermined button depending on user's demand. Description will be made below on the assumption that the ice and the water dispensers are separately installed.

An ice making unit for supplying ice to the ice dispenser 17 and a water cooling unit for supplying cold water to the water dispenser 19 are located on the inside of the door.

Figure 2:
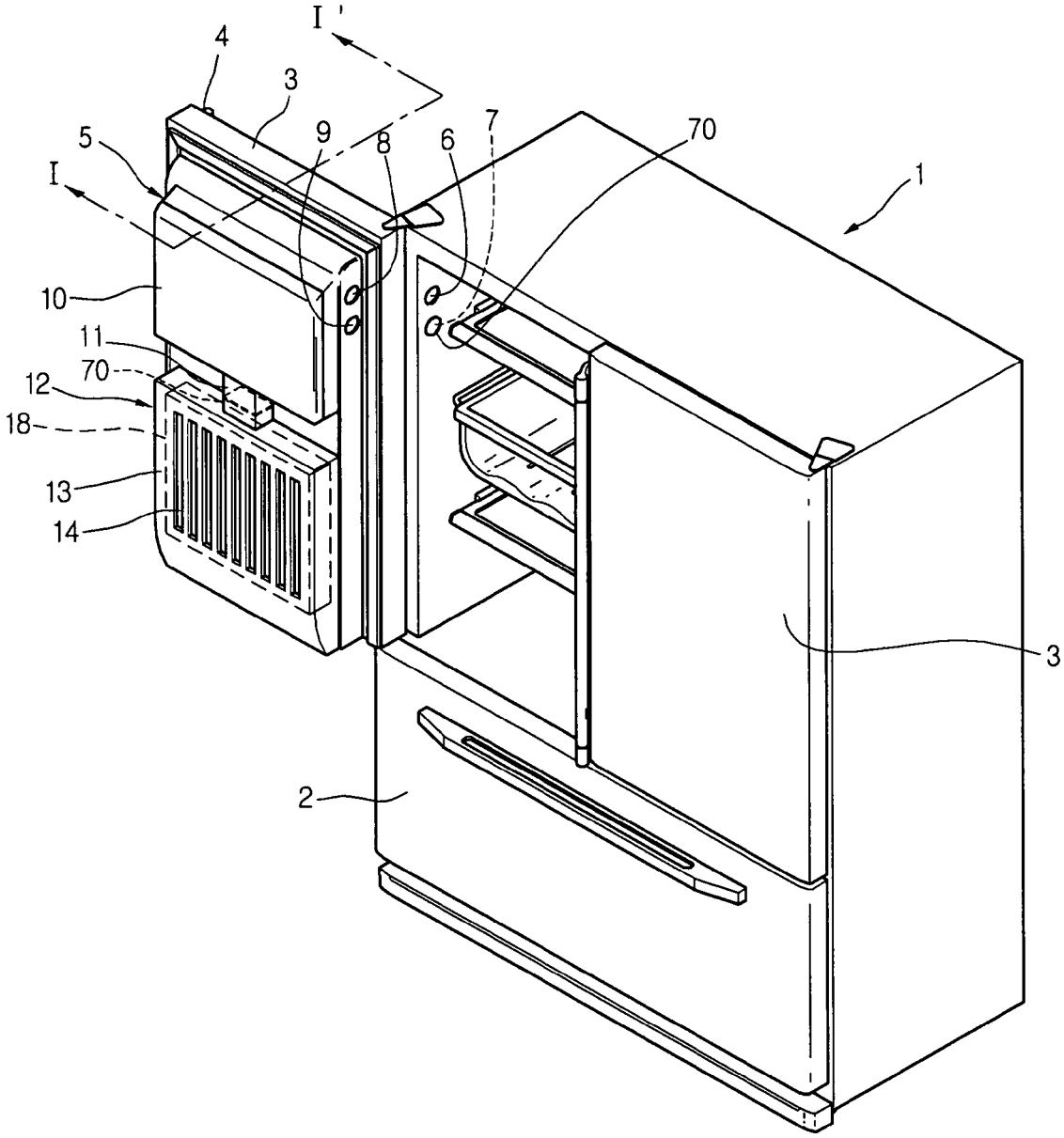
FIG. 2 is a perspective view illustrating an inside of a refrigerating room door in the refrigerator shown in FIG. 1.

FIG. 2 is a perspective view illustrating an inside of a refrigerating room door in the refrigerator shown in FIG. 1.

Referring to FIG. 2, the inside of the refrigerating room door 3 includes an ice making chamber 5 located at the top for making ice, a water storage tank 12 located at the bottom of the ice making chamber 5, for cooling water, and a connecting duct 11 for guiding the cooling air from the ice making chamber 5 to the water storage tank 12.

In detail, the ice making chamber 5 includes: an ice making chamber cover 10 for allowing the cooling air to be swiftly guided to the connecting duct 11 by opening/closing an interior of the ice making chamber 5; an intake port of the ice making chamber 8, located at one side of the ice making chamber 5 and connected to a main body discharge port 6, for supplying the cooling air to the ice making chamber 5; and a discharge port of the ice making chamber 9, formed on the other side of the ice making chamber 5 and connected to a main body intake port 7, for circulating the cooling air that has been used to operate the ice making chamber back to the main body. Of course, the main body discharge port 6 and the main body intake port 7 are elements of the circulation system of the cooling air produced by the evaporator and allow the cooling air to be supplied to the ice making chamber in cooperation with the cooling air passages within the refrigerator.

In more detail, a side of the water storage tank cover 13 that seals the water storage tank 12 from the refrigerating room is vented so that a portion of the water storage tank 12 is opened to allow the cooling air to be vented through an air discharge port toward the refrigerating room. The cooling air that cools the water storage tank should be vented back into the refrigerating room, since the water in the water tank might freeze if the air discharge port is not present. Also, the time it takes to cool the water in the water storage tank is unacceptably prolonged if the water in the water storage tank is cooled using only existing cooling air in the refrigerating room.

In operation, the cooling air in the refrigerator passes through the intake port of the ice making chamber 8 into the ice making chamber 5 to be used for making ice. While some of the cooling air that is used to operate the ice making chamber 5 passes back through the exhaust port of the ice making chamber 9 to the upper part of the refrigerator, most of the cooling air passes through the connecting duct 11 to the water storage tank 12 to quickly cool the water in the water storage tank 12.

The reason why the cooling air that has been used to operate the ice making chamber 5 is reused for cooling the water in the water storage tank 12 is that the cooling air that has been used to make ice in the ice making chamber 5 still contains a substantial amount of coldness. Of course, it is easily understood that the temperature of the cooling air that passes through the ice making chamber 5 after being used is lower than the temperature of the cooling air inside the refrigerating room. Also, the cooling air that has been used to cool the water in the water storage tank 12 passes through the air discharge port 14 into the refrigerating room to cool foodstuffs stored therein in this time. Because the ice making chamber cover 10 partitions the inside of the ice making chamber 5 from the inside of the refrigerating room, the cooling air supplied to the inside of the ice making chamber 5 does not leak into the inside of the refrigerating room, and thus can be supplied to the water storage tank 12 in its entirety.

Figure 3:
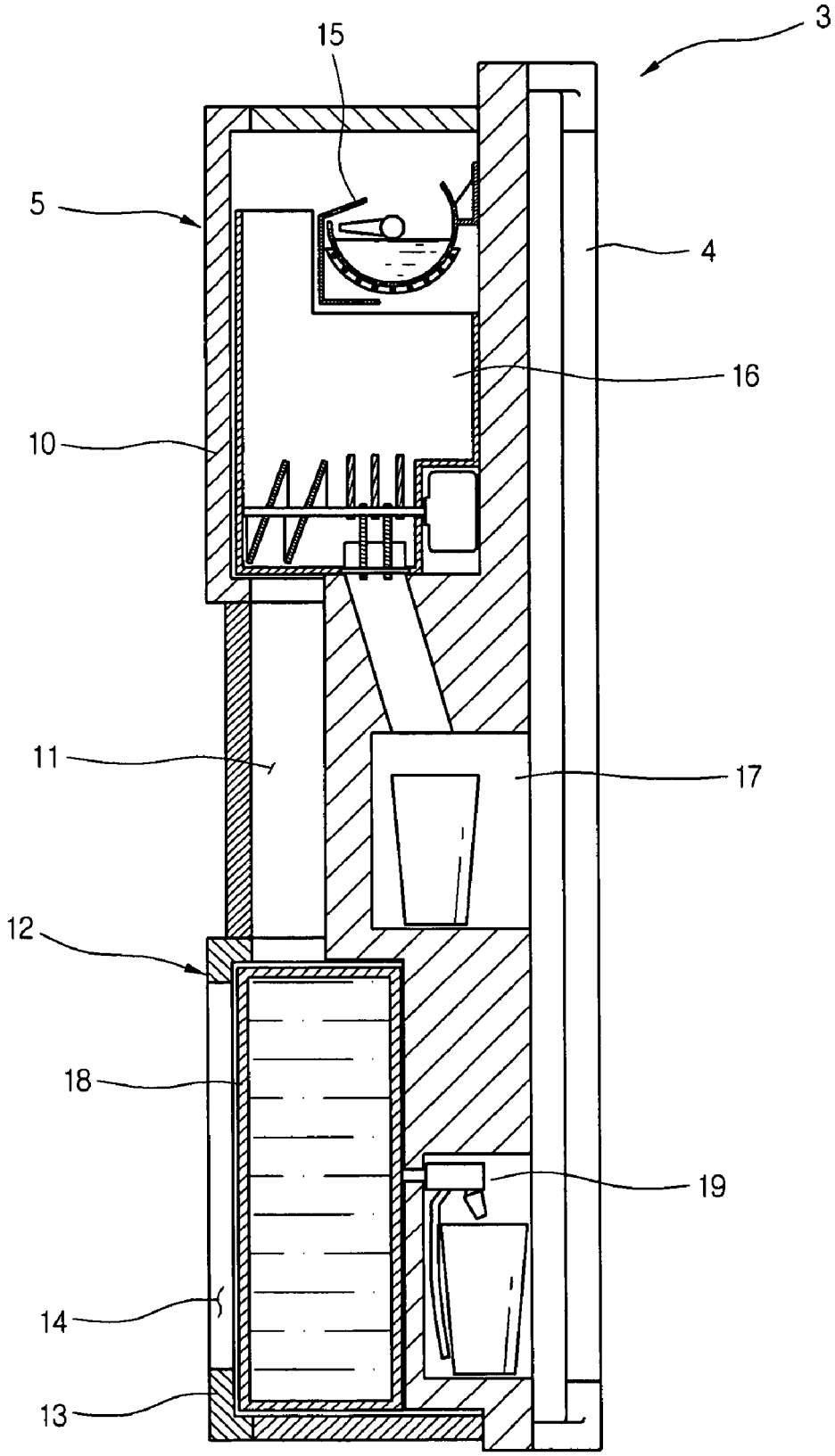
FIG. 3 is a cross-sectional view taken along line I-I' of FIG. 2.

Referring to FIG. 3, which is a cross-sectional view taken along line I-I' of Fig., a detailed description of a cooling air flow passage of a refrigerator according to the present invention will be made below.

Referring to FIG. 3, the upper part of the cross-section depicts an ice making unit, while a water dispensing unit is depicted below the ice making chamber 5.

In more detail, the ice making unit includes an ice maker 15 for making ice of a uniform size, an ice bank 16 for storing the ice made by the ice maker 15, and an ice dispenser 17 for dispensing the ice (stored in the ice bank 16) of adequate size and quantity to a user. Also, the water dispensing unit includes a water tank 18 for storing water cooled by the cooling air from the ice making chamber, an air discharge port 14 formed by opening at least part of the water storage tank cover 13, for discharging the cooling air supplied to the water storage tank 12 to the interior of the refrigerating room, and a water dispenser 19 for dispensing an adequate amount of water stored in the water tank 18 to a user.

Furthermore, a connecting duct 11 allows the cooling air in the ice making chamber 5 to flow downward with gravity to the water storage tank 12.

According to the cooling air flow passage of the refrigerator of the present invention, the cooling air is supplied to the ice making chamber 5 to freeze water, passes through the connecting duct 11 to the water storage tank 12 to cool the water stored in the water tank 18, and discharges into the refrigerating room to cool the foodstuffs. Regarding the temperatures of each portion, it is apparent that the temperature of the ice making chamber 5 is the lowest, followed by that of the water tank 18, and that of the refrigerating room.

As described above, because the water in the water storage tank 12 is cooled directly by the cooling air from the ice making chamber 5, a large quantity of water can quickly be cooled, and loss of the cooling air during the transfer of the cooling air through the connecting duct can be minimized. Also, because the water storage tank 12 is located below the ice making chamber 5, the colder air in the ice making chamber 5 can easily move downward with gravity to the water storage tank 12.

In an aspect of the present invention not yet described, a damper 70 can be fixed to either the discharge port of the ice making chamber 9 and/or the connecting duct 11 to control the amount of the cooling air that flows through the connecting duct 11 and the amount of the cooling air that flows through the discharge port of the ice making chamber 9. If the temperature in the ice making chamber 12 reaches below zero, the damper 70 in the connecting duct 11 can be partially closed and the damper 70 in the discharge port of the ice making chamber 9 can be partially opened to prevent the water in the water storage tank 12 from freezing.

Furthermore, in the case where the discharge port of the ice making chamber 9 and the main body intake port 7 are not provided to the refrigerator, the entirety of the cooling air in the ice making chamber will flow through the connecting duct 11, thereby cooling the water in the water storage tank 12 that much more quickly.

Figure 4:
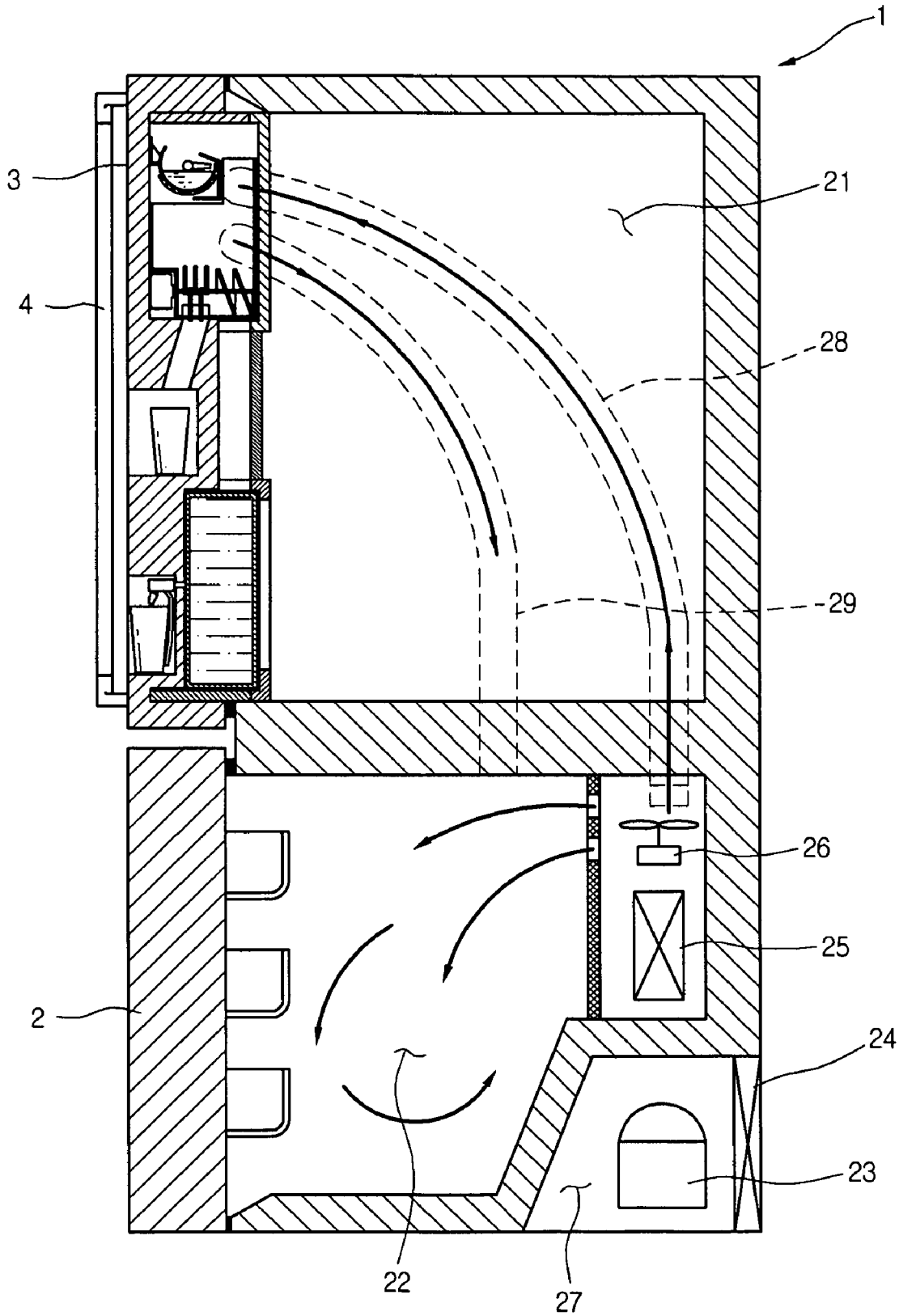
FIG. 4 is a cross-sectional view taken along line II-II' of FIG. 1.

Referring to FIG. 4, which is a cross-sectional view taken along line II-II' of FIG. 1, overall description of the cooling air flow passage of the refrigerator according to the present invention will be made below.

A freezing room 22 is located at the bottom of a bottom freezer-type refrigerator 1, and a refrigerating room 21 is located on top of the freezing room 22. Also, a machine compartment 27 is located behind the freezing room 22. Of course, a compressor 23, a condenser 24, and an evaporator 25 are located in the machine compartment 27 or nearby, to create cooling air so as to supply the cooling air to the refrigerating room 21 and the freezing room 22.

On the one hand, the cooling air created by the evaporator 25 is propelled by a ventilating fan 26 through an intake duct 28 to the ice making chamber 5, where the cooling air is used to make ice. After the cooling air is used to make ice in the ice making chamber 5, the remaining cooling air can be supplied via the connecting duct 11 to the water storage tank or the freezing room 22 via an exhaust duct 29. The exhaust duct 29 is, of course, connected to the refrigerating room 21 to exhaust the cooling air into the refrigerating room 21, and can also be connected to the freezing room 22 via a separate cooling air flow passage (not shown) to supply the freezing room with the cooling air created by the evaporator 25.

In addition, the cooling air that passes through the connecting duct 11 to the water storage tank 12 can create a low temperature atmosphere in the refrigerating room 21 by supplying the refrigerating room with the cooling air via the air discharge port 14. Moreover, since the cooling air discharged from the water storage tank 12 has been heated to some extent, the cooling air may be supplied to the refrigerating room 21. Thus, in case a water dispensing unit and an ice making unit are integrally formed, they may be located on the refrigerating room door.

Another aspect of the present invention involves the ice maker 15 being positioned on the refrigerating room door 3, which allows the interior of the refrigerating room to be used more efficiently. In addition, because the ice maker 15 is fixed to the door, the cooling air used to cool the ice maker 15 can easily be guided to the water storage tank 12.

If the ice maker 15 were to be located inside the refrigerator and not on the door, the dispensing of the ice would not be easy and the ice maker would occupy the interior storage space of the refrigerating room. Also, not only would the passages for guiding the cooling air to the ice making unit be unduly complicated, but also the structure of the connecting duct for connecting the ice making chamber with the water storage tank would become complicated as well. Therefore, the present invention may be embodied in a more preferable way by locating the ice making chamber 15 on the refrigerating room door 3.

Also, a door handle 4 is located on the front of the refrigerating room door 3 so that a user may open the door.

The description has been made mainly for the case that the cooling air flow passage of the present invention has been applied to a bottom freezer-type refrigerator. However, the present invention is not limited to such refrigerators, but can readily be applied to a top mount-type refrigerator, which employs separate refrigerating and freezing rooms that are located on the top and the bottom of the refrigerator, or a side-by-side-type refrigerator, which employs separate refrigerating and freezing rooms located on the left and the right of the refrigerator. Below are explanations of applications of the present invention when manifested in other types refrigerators.

Figure 5:
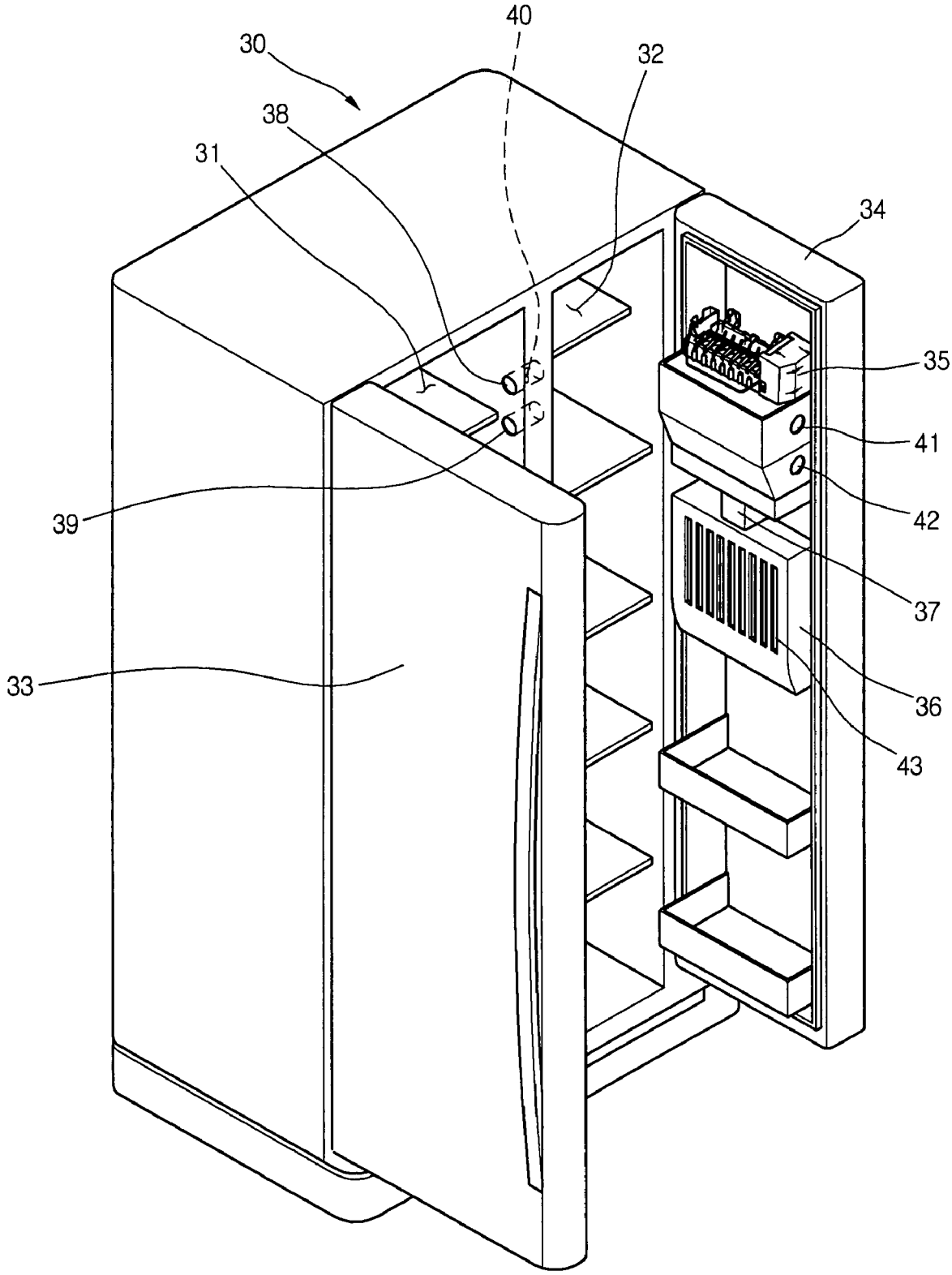
FIG. 5 is a perspective view of a side-by-side-type refrigerator to which the present invention is applied.

FIG. 5 is a perspective view of a side-by-side-type refrigerator to which the present invention is applied Referring to FIG. 5, a side-by-side-type refrigerator 30 includes a refrigerating room 32 on the left side and a freezing room 31 on the right side, which can be opened and closed using a refrigerating room door 34 and a freezing room door 33, respectively. Also, there is an ice making chamber 35 for making ice on the upper inside portion of the refrigerating room door 34 and a water storage tank 36 for cooling water located below the ice making chamber 35. In FIG. 5, an ice making chamber cover has purposely been omitted so that the interior structure can be viewed. The locations of the refrigerating and freezing rooms shown can be respectively switched from left to right.

Also, cooling air can flow from an ice making chamber 35 to a water storage tank 36 via a cooling duct 37 between the ice making chamber 35 and the water storage tank 36 or through an air discharge port on the inside of the water storage tank 36 into the refrigerating room 32.

In addition, in order to provide the ice making chamber 35 with the cooling air, an intake port of the ice making chamber 41 and an exhaust port of the ice making chamber 42 are formed on the side of the ice making chamber; and an intake passage 38 and a discharge passage 39 are formed in a wall where the intake port of the ice making chamber 41 and the exhaust port of the ice making chamber 42 face each other and by which the freezing room is separated from the refrigerating room, to pass through and connect the refrigerating and the freezing rooms when the refrigerator doors are closed.

Furthermore, the amount of cooling air that flows through the intake passage 38 can be regulated and a ventilating fan 40 can be added inside the intake passage 38 to uniformly ventilate cooling air.

Of course, the intake passage 38 and/or the discharge passage 39 can be located nearby and connected directly to the evaporator (as in applications of the prior art), and not to the freezing room 31.

An explanation of the operation and function of the cooling air flow passage in the above refrigerator will now be given.

The cooling air in the freezing room 31 is kept at temperatures below zero, and supplied to the ice making chamber 35 via the intake passage 38. The cooling air, after flowing into the ice making chamber 35 to make ice, flows through the connecting duct 37 into the water storage tank 36 or through the discharge passage 39 back to the evaporator (not shown).

Also, the cooling air that has been used to cool the water in the water storage tank 36 flows through an air discharge port 43 into the refrigerating room 32, and keeps the foodstuffs stored in the refrigerating room cold. As described in the one embodiment of the present invention, if the discharge passage 39 and the discharge port of the ice making chamber 42 are not present in the refrigerator, all the cooling air in the ice making chamber 35 can be supplied to the water storage tank 36. In that case, the water in the water storage tank 36 is cooled more rapidly.

Figure 6:
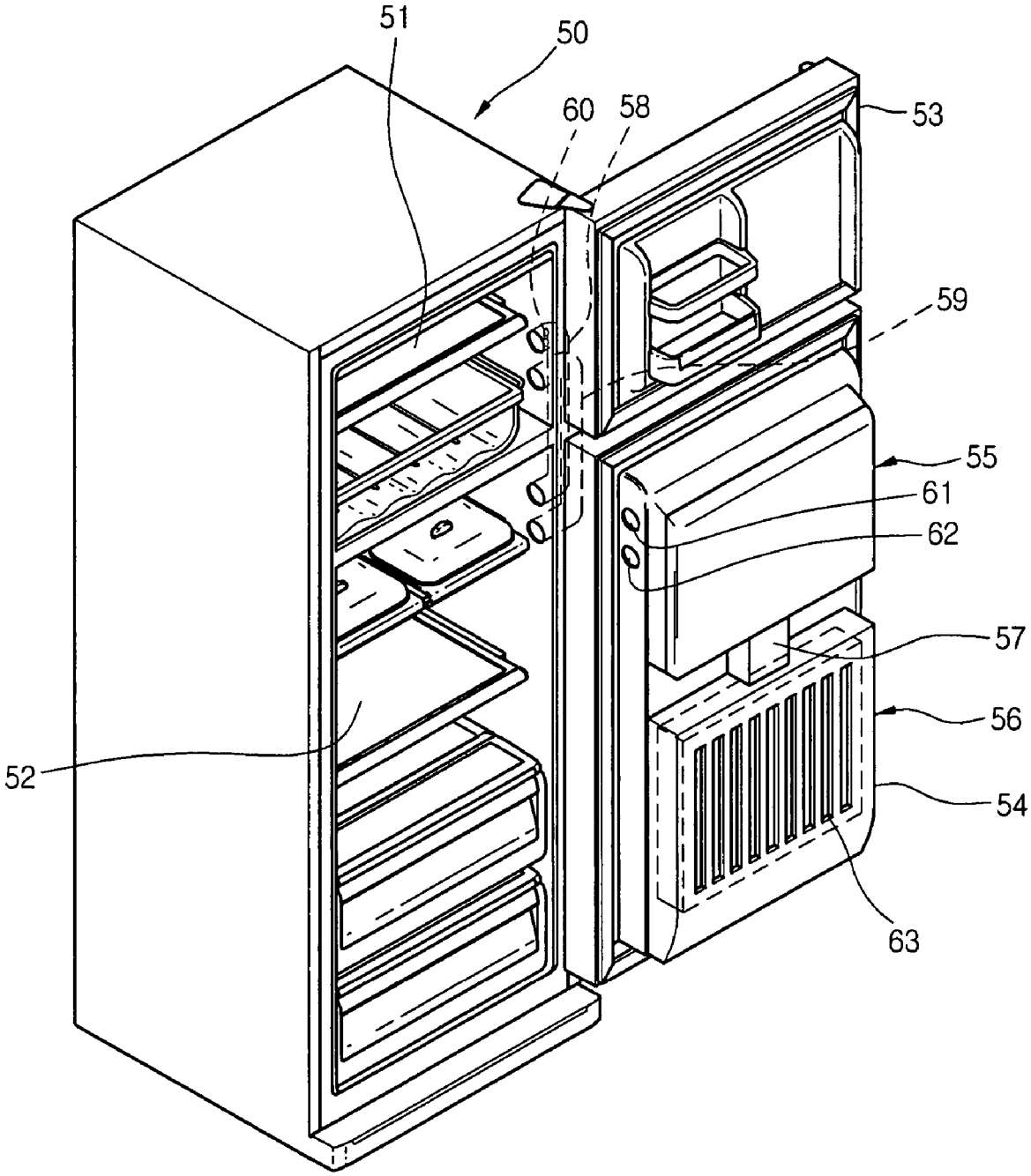
FIG. 6 is a perspective view of a top mount-type refrigerator to which the present invention is applied.

FIG. 6 is a perspective view of a top mount-type refrigerator to which the present invention is applied.

Referring to FIG. 6, a top mount-type refrigerator 50 includes a freezing room 51 located in the top portion of the refrigerator and a refrigerating room 52 located in the bottom portion of the refrigerator, which are opened and closed via a freezer room door 53 and a refrigerating room door 54, respectively. Further, an ice making chamber 55 for making ice is formed in the upper inner portion of the refrigerating room door 54, and a water storage tank 56 for cooling water is formed below the ice making chamber 55.

Additionally, cooling air can flow from the ice making chamber 55 to the water storage tank 56 through a connecting duct 57 between the ice making chamber 55 and the water storage tank 56, or into the refrigerating room 52 through an air discharge port formed on the inside of the water storage tank 56.

Furthermore, in order to provide the ice making chamber 55 with cooling air, an intake port of the ice making chamber 61 and a discharge port of the ice making chamber 62 are formed on the side of the ice making chamber 55. An intake passage 58 and a discharge passage 59 connected with the freezing room are formed on the area of the main body of the refrigerator where the intake port of the ice making chamber 61 and the discharge port of the ice making chamber 62 touches the main body of the refrigerator when the refrigerating room door 54 is closed. Further, a ventilating fan 60 can be installed in the intake passage 58 to uniformly regulate the amount of cooling air that flows through the intake passage 58.

Of course, the intake passage 58 and/or the discharge passage 59 can be located nearby and connected directly to the evaporator (as in applications of the prior art), and not to the freezing room 51.

An explanation of the operation and function of the cooling air flow passage in the top mount-type refrigerator will now be given.

The cooling air in the freezing room 51 is kept at a temperature below zero and supplied to the ice making chamber 55 through the intake passage 58. After being used to make ice in the ice making chamber 55, the cooling air is supplied to the water storage tank 56 through the connecting duct 57 or back to the freezing room 51 through the discharge passage 59. In order to control the amount of the cooling air flowing through the connecting duct 57 and the discharge passage 59, a damper (not shown) can be installed inside the discharge passage 59.

Also, the cooling air that has been used to cool the water in the water storage tank 56 flows into the refrigerating room 32 through the air discharge port 63 to keep the foodstuffs in the refrigerating room 32 cold.

The cooling air in the ice making chamber of the above-described refrigerator can also be used to cool the water in the water storage tank, thereby simplifying the cooling air flow passage, as well as allowing the ice making unit and the water dispensing unit to operate simultaneously.

Also, by simplifying the cooling air flow passage, the energy efficiency of the refrigerator can be improved and a larger quantity of water can be cooled quickly to be dispensed to a user.

In addition, since the cooling air flow passage of the refrigerator that incorporates the ice making unit and the water dispensing unit into a single unit can be simplified, the refrigerator layout is simplified even more and a manufacturing cost is reduced.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A cooling air flow passage of a refrigerator, comprising:

an ice making chamber that makes ice using cooling air introduced from an outside source;

a water storage tank that cools water accommodated therein using the cooling air that has passed through the ice making chamber; and a connecting duct that connects the ice making chamber with the water storage tank, the connecting duct guiding the cooling air from the ice making chamber to the water storage tanks, wherein a temperature of the cooling air passed through the ice making chamber is higher than a temperature of the cooling air from the outside source.

2. The passage according to claim 1, wherein the ice making chamber is located above the water storage tank.

3. The passage according to claim 1, wherein the ice making chamber and/or the water storage tank is installed on a door.

4. The passage according to claim 1, further comprising an ice making chamber cover that separates the ice making chamber from an inside of the refrigerator.

5. The passage according to claim 1, wherein the water storage tank includes a water tank spaced a predetermined distance inside the water storage tank.

6. The passage according to claim 1, further comprising: an air discharge port formed on a cover of the water storage tank, the air discharge port allowing the cooling air of the water storage tank to be discharged to an inside of the refrigerator.

7. The passage according to claim 1, wherein the ice making chamber and/or the water storage tank are/is formed on an inside of a refrigerating room door.

8. The passage according to claim 1, further comprising a passage that connects the ice making chamber with an evaporator.

9. The passage according to claim 1, further comprising a plurality of passages that connects the ice making chamber with the evaporator.

10. The passage according to claim 1, wherein the ice making chamber is formed in a refrigerating room, and a passage that connects the ice making chamber with a freezing room is provided.

11. A cooling air flow passage of a refrigerator, comprising:

an ice making chamber that supplies ice to an ice dispenser;

a water storage tank that supplies water to a water dispenser;

a connecting duct that connects the ice making chamber with the water storage tank, the connecting duct causing cooling air that has passed through the ice making chamber to flow into the water storage tank; and a passage having one end connected with the ice making chamber, the passage supplying cooling air, wherein a temperature of the cooling air passed through the ice making chamber is higher than a temperature of the cooling air from the outside source.

12. The passage according to claim 11, wherein the other end of the passage is connected with the evaporator.

13. The passage according to claim 11, wherein the other end of the passage is connected with a freezing room.

14. The passage according to claim 11, wherein the passage is provided in the form of a pair of passages, one for inflow and the other for outflow of the cooling air.

15. The passage according to claim 11, wherein the passage includes a ventilating fan that forces the flow of the cooling air.

16. The passage according to claim 11, wherein the water storage tank is installed in a refrigerating room, and at least a portion of an outer wall of the water storage tank is opened.

17. A cooling air flow passage of a refrigerator, comprising:

an ice making unit installed on a refrigerating room door;

a water dispensing unit installed near the ice making unit;

a connecting duct that guides cooling air that has passed through the ice making unit to the water dispensing unit; and a passage having one end connected to one end of the ice making unit, the passage guiding inflow/outflow of the cooling air.

18. The passage according to claim 17, further comprising a damper formed on the connecting duct.

19. The passage according to claim 17, further comprising a damper formed on the passage for the outflow among the passages.

20. The passage according to claim 17, further comprising a ventilating fan formed on the passage for the inflow among the passages.

21. The passage according to claim 1, wherein the cooling air passage through the ice making chamber is used to make ice in the ice making chamber.

22. The passage according to claim 1, wherein the cooling air passage through the ice making chamber is used to cool the ice received in the ice storage bin in the ice making chamber.

* * * * *